United States Patent [19]

White et al.

[11] Patent Number: 5,038,802

[45] Date of Patent: Aug. 13, 1991

[54] FLAVOR SUBSTANCES FOR SMOKING ARTICLES

[75] Inventors: Jackie L. White; Richard L. Blakley, both of Pfafftown; Edward Bernasek; William M. Hildebolt, both of Winston-Salem; Michael D. Shannon, Lewisville; Gary R. Shelar, Greensboro, all of N.C.

[73] Assignee: R. J. Reynolds Tobacco Company, Winston-Salem, N.C.

[21] Appl. No.: 435,951

[22] Filed: Nov. 13, 1989

Related U.S. Application Data

[63] Continuation-in-part of Ser. No. 287,939, Dec. 21, 1988.

[51] Int. Cl.[5] ..... A24B 15/24

[52] U.S. Cl. ..... 131/297; 131/290; 131/275

[58] Field of Search ..... 131/290, 275, 276, 297, 131/298

[56] References Cited

U.S. PATENT DOCUMENTS

| | | |
|---|---|---|
| 678,362 | 7/1990 | Fruehling . |
| 3,174,485 | 3/1965 | Griffith et al. . |
| 3,316,919 | 5/1967 | Green et al. . |
| 3,424,171 | 1/1969 | Rooker . |
| 3,803,004 | 9/1974 | Egri . |
| 4,079,742 | 3/1978 | Rainer . |
| 4,150,677 | 4/1979 | Osborne, Jr. et al. . |
| 4,708,151 | 11/1987 | Shelar et al. . |
| 4,714,082 | 12/1987 | Banerjee et al. . |
| 4,732,168 | 3/1988 | Resce et al. . |
| 4,756,318 | 7/1988 | Clearman et al. . |
| 4,771,795 | 9/1988 | White et al. . |
| 4,793,365 | 12/1988 | Sensabaugh, Jr. et al. . |
| 4,827,950 | 5/1989 | Banerjee et al. . |
| 4,881,556 | 11/1989 | Clearman et al. . |

FOREIGN PATENT DOCUMENTS

| | | |
|---|---|---|
| 1383029 | 6/1972 | United Kingdom . |

OTHER PUBLICATIONS

Ames. Mut. Res. 31P 347-365 (1975).
Nago, Mut. Res. 42:335-342 (1975).
Roerrade et al., J. Agr. Food Chem., 20: 1035 (1972).

*Primary Examiner*—V. Millin
*Attorney, Agent, or Firm*—Grover M. Myers; David G. Conlin

[57] ABSTRACT

The flavor substances of the present invention are prepared by toasting (heating) natural tobacco in an inert atmosphere at a temperature of at least about 225° C., fractionating the volatiles and collecting at least a portion of the fractionated materials as the flavor substances. This fractionating and/or collecting can be conducted by condensation, liquid-liquid extraction, sorption (adsorption and/or absorption) and the like, with either a solid or liquid sorbent medium. Either the sorbent medium containing the trapped volatiles or the volatiles themselves may be used as the flavor substances of the present invention.

31 Claims, 4 Drawing Sheets

FLAVOR SUBSTANCES FOR SMOKING ARTICLES

CROSS REFERENCE TO RELATED APPLICATION

This application is a continuation-in-part of copending application Ser. No. 07/287,939, filed Dec. 21, 1988, the disclosure of which is hereby incorporated herein by reference.

BACKGROUND OF THE INVENTION

The present invention is directed to novel flavor substances, i.e., flavor additives, for cigarettes and other smoking articles, and to a process for preparing such flavor substances.

Cigarettes, cigars and pipes are the most popular forms of tobacco smoking articles. Many smoking products and improved smoking articles have been proposed through the years as improvements upon, or as alternatives to, these popular forms of tobacco smoking articles. Examples of improved smoking articles are the cigarettes and pipes described in U.S. Pat. Nos. 4,756,318, 4,714,082, and 4,708,151, which generally comprise a fuel element, a physically separate aerosol generating means, and a separate mouthend piece.

Tobacco substitute smoking materials have likewise been proposed as improvements upon and/or as alternatives to tobacco. See, e.g., U.S. Pat. No. 4,079,742 to Rainer et al.

Generally, natural tobacco flavors are important for the taste, aroma and acceptance of smoking products, including substitute smoking materials. Thus, the search for natural tobacco flavor additives (or flavor substances) is a continuing task.

For instance, in U.S. Pat. No. 3,424,171 there is described a process for the production of a non-tobacco smokable product having a tobacco taste. Tobacco was subjected to a moderate (i.e., below scorching) heat treatment, i.e., at from about 175° to 200° C. (or about 350°–400° F.), to drive off aromatic components. These components were trapped on adsorbent charcoal, and removed from the charcoal by solvent extraction. The smokable product was vegetable matter, treated with the mixture of tobacco aromatic components and the solvent.

Similarly, U.S. Pat. No. 4,150,667 describes a process for the treatment of tobacco which comprises the steps of: (1) contacting tobacco which contains relatively high quantities of desirable flavorants with a stream of non-reactive gas, under conditions whereby the tobacco is heated in a temperature range from about 140° to about 180° C.; (2) condensing the volatile constituents of the resulting gaseous stream; and (3) collecting said condensate. The condensate may be used subsequently to flavor a smoking material in order to enhance the organoleptic properties of its smoke.

British Patent No. 1,303,029 describes a method for obtaining tobacco aroma substances which comprises an extraction treatment wherein the components of the tobacco which are soluble in a suitable solvent are extracted and the residue obtained after removing the solvent is subjected to heat treatment at a temperature from 30° to 260° C.

Similarly, in U.S. Pat. No. 3,316,919, a process for improving the taste of smoking tobacco is described which entails adding a powder of freeze dried aqueous tobacco extract to tobacco cut filler in amounts ranging from about 5 to 10% by weight.

SUMMARY OF THE INVENTION

The present invention generally relates to a process for the production of natural tobacco flavor substances useful in tobacco smoking products as flavor enhancers, and in tobacco substitute materials as a source of tobacco smoke flavor and/or aroma.

The tobacco smoke flavor substances of the present invention are derived by high temperature (≧200° C.) "toasting" that is, heating natural tobacco, e.g., Burley, Flue Cured, Turkish, and/or various blends thereof, in an inert atmosphere, at a temperature sufficient to drive-off the desired volatile materials; fractionating the volatile materials; and collecting at least a portion of the fractionated volatiles as flavor substances.

In the present invention, the tobacco is toasted, preferably at atmospheric pressure (but higher or lower pressures may be used), at a temperature of at least about 200° C., preferably less than about 500° C., and more preferably from about 300° C. to about 450° C., thereby driving off volatile materials. The most preferred temperature range for toasting the tobacco at atmospheric pressure is about 375° C. to about 400° C. When the toasting is conducted at lower pressures, lower temperatures are effective for driving off the desired volatile materials. Those having ordinary skill in the art to which this invention pertains, with benefit of the present disclosure, will readily be able to determine appropriate temperatures for subatmospheric and super- atmospheric pressures.

Undesirable components in the volatile gases including water, sugars, waxes, and dense organic components are removed from the gaseous vapors by fractionation. As used herein, the terms "fractionation" and/or "fractionating" are used to refer generically to the various physical and/or chemical separation techniques used herein to prepare the desired flavor substances.

In one embodiment, this fractionating is preferably accomplished by condensation, e.g., by using one or more, preferably about three condensers (e.g., cold traps), maintained within the temperature range of from about −50° C. to about 20° C., preferably from about −10° C. to about 5° C., and most preferably at about 0° C.

The use of one or more condensers causes various gaseous components to be removed from the toasted tobacco gas stream, thereby fractionating the same.

In another embodiment, the fractionating is conducted by a liquid-liquid separation technique. In this embodiment, the toasted tobacco gas stream is passed through one or more water-imiscible solvent baths (e.g., triacetin). The temperature of the solvent baths may vary, e.g., from cold (e.g., −200° C.) to near boiling. One preferred temperature for triacetin is room temperature. The use of a water-imiscible solvent allows the aqueous phase components of the toasted tobacco gas stream to be removed from the organic phase components. Typically after a sufficient contact period, e.g., one to several hours, two liquid layers appear, one aqueous (top) one organic (bottom). Usually the desired flavor substances are found in the organic layer.

In a variation on this embodiment, the use of various temperatures for each of the water-imiscible solvent baths allows for sequential (i.e., continuous downstream) fractionation of the toasted tobacco gas stream, with each solvent bath capturing a different type of flavor substance from the gas stream. This method allows for the re-blending of satisfactory tastes and aromas, enabling the custom formation of a final flavor substance combination.

Thus, the present invention is directed to novel tobacco smoke flavor compositions, as well as to the processes for preparing the same. It is also directed to the use of these flavor substances as a supplemental flavor additive and as a flavor component in cigarette, cigar, and/or pipe smoking articles.

Preferably, the smoking articles which employ the improved flavor substance of the present invention are cigarettes which utilize a short, i.e., less than about 30 mm long, preferably carbonaceous, fuel element. Preferably, these cigarettes include an aerosol generating means which is longitudinally disposed behind the fuel element and a heat conductive container which receives heat from the burning fuel element. A roll of tobacco surrounds the conductive container. The mouthend piece of such cigarettes preferably comprises a filter segment, preferably one of relatively low efficiency, so as to avoid interfering with delivery of the aerosol produced by the aerosol generating means. See for example, U.S. Pat. Nos. 4,756,318, 4,714,082, and 4,708,151, the disclosures of which are hereby incorporated herein by reference.

The flavor substances of the present invention may also be added to cigarettes as a top dressing or as a humectant, or in any other convenient mode selected by the manufacturer. In preferred smoking articles, the flavor substances of the present invention may be added to the aerosol generating means, the tobacco, and/or the mouthend piece components to contribute tobacco smoke flavors, as may be desired. Preferably, the flavor substances are added to a relatively cool region of the article, i.e., away from the fuel element, e.g., in the mouthend piece. In such a location, the flavor benefit to be derived from the added flavor substances will become most apparent at the time other article components are being depleted of their flavors, thus assuring the user of full satisfaction throughout the duration of the use of the article.

The flavor substances of the present invention are particularly advantageous because they are capable of providing a good tobacco smoke taste to cigarettes and other smoking articles. Moreover, these flavor substances produce no significant mutagenic activity as measured by the Ames test. See Ames et al., *Mut. Res.*, 31: 347–364 (1975) and Nagao et al , *Mut. Res.*, 42: 335 (1977).

The improved flavor substances of the present invention and cigarettes and other smoking articles which employ the flavor substances of present invention are described in greater detail in the accompanying drawings and detailed description of the invention which follow.

DETAILED DESCRIPTION OF THE PREFERRED EMBODIMENTS

The tobacco smoke flavor substances of the present invention are derived by the "toasting" of natural tobacco, e.g., Burley, Flue Cured, Turkish, and/or various blends thereof.

As used herein, the term "toasting" refers to the process of heating tobacco in a suitable container, under an inert atmosphere, within a temperature range sufficiently high to drive-off volatiles, without excessively charring or burning the tobacco. Generally this temperature range has been found to be between about 225° C. and about 450° C., at atmospheric pressure.

Figure 1:
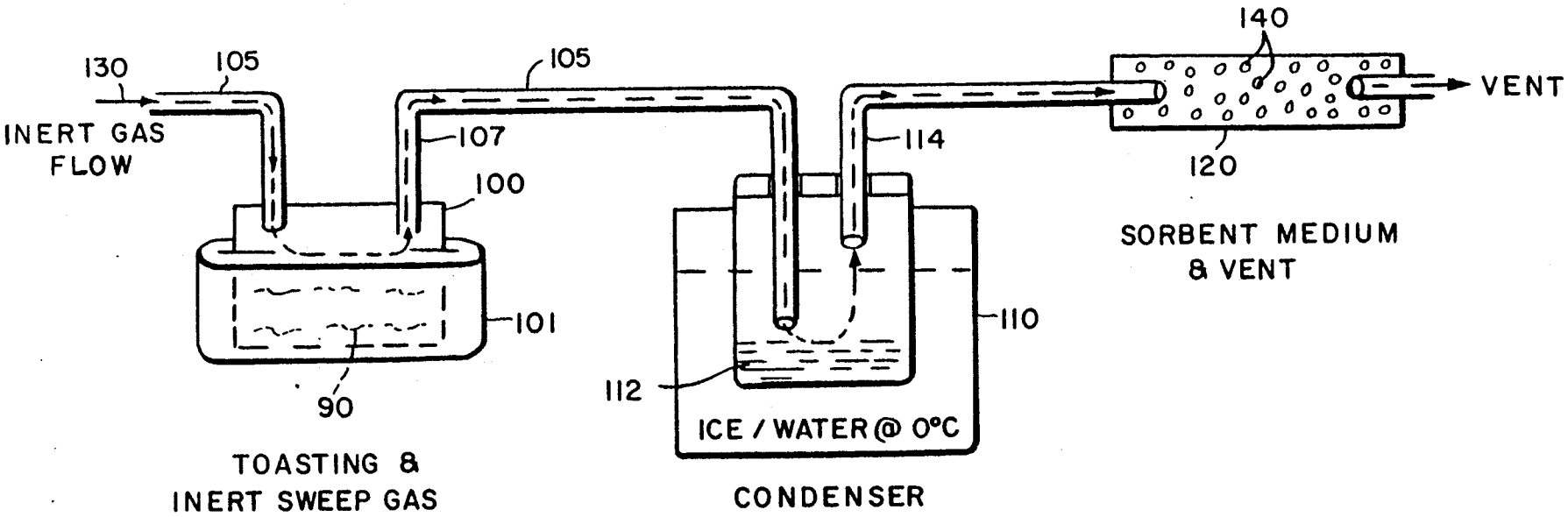
FIG. 1 is a schematic flow diagram illustrating one the present invention.

FIG. 1 illustrates one process of the present invention in schematic form. Tobacco 90 is placed in a suitable container 100 (e.g., on a laboratory scale process, a 1000 ml glass round-bottom flask) which is provided with heating means 101 such as an electric heating mantle. Container 100 is connected by a suitable connecting member 105, e.g., glass tubing, to condensing means 110, (e.g., at least one conventional cold trap) and to a sorbent medium container 120. Container 100 and its contents 90 are brought to the desired toasting temperature (e.g., preferably about 350°–450° C.) an inert gas 130 is swept through the container 100 to sweep the volatile components 107 toward the condensing means 110. In the condensing means 110, a portion 112 of the volatile components are condensed out of the gas stream, and the remaining gaseous components 114 are swept onward to the sorbent medium container 120, where at least a portion of them are trapped by the sorbent medium 140. The sweep gas 130 exiting the sorbent medium container 120 is preferably vented to the atmosphere. Alternatively, the exiting sweep gas may be passed back to the container 100 for use as a part of the starting sweep gas 130.

As illustrated in FIG. 1, disposed between the ultimate sorbent medium 140 which is used to trap the desired tobacco smoke flavor substances, and the source of such volatile tobacco components, is a condenser means advantageously comprising at least one, preferably three, cold traps which serve to remove a portion of the volatile components released during the toasting of tobacco. The temperature of the condensing means is generally within the range of from about −50° C. to about 20° C., preferably from about −10° to about 5°, and most preferably about 0° C. Depending upon the temperature of the condenser, various volatile components of the toasted tobacco will be removed from the gas stream. Typically, these components include water, waxes, sugars, and the like.

Effluent gasses passing from the condenser(s) are absorbed or adsorbed by either a solid or liquid sorbent medium. Suitable sorbents are known and available to the skilled artisan, and include solids such as carbon (activated or unactivated), alumina, alpha alumina, tobacco, diatomaceous earth, clays, and the like. Suitable liquid sorbents include those materials typically used in the manufacture of cigarettes, including humectants, such as glycerin, propylene glycol. Other liquid sorbent media useful herein include triacetin, vegetable oils, e.g., sunflower, corn, peanut, etc. Especially preferred solid sorbent media are sintered alpha alumina and activated carbon. An especially preferred liquid sorbent medium is triacetin.

In one preferred embodiment, tobacco is toasted at atmospheric pressure, and at a temperature of about 375° C. for two hours, to drive off volatile components. The vapors from this toasted tobacco are swept via nitrogen gas through at least one cold trap maintained at 0° C., and the vapors passing through the condenser are collected on alpha alumina.

Figure 2A:
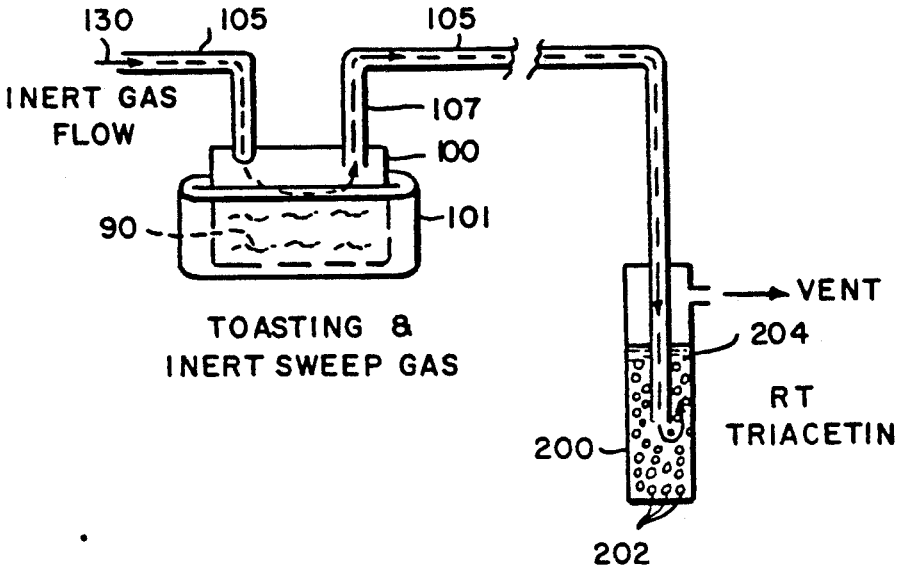
FIGS. 2A and are schematic flow diagrams illustrating two additional preferred processes of the present invention.

FIG. 2A illustrates another process of the present invention in schematic form. As before, tobacco 90 is placed in a suitable container 100 (e.g., on a laboratory scale process, a 1000 ml glass round-bottom flask) which is provided with heating means 101 such as an electric heating mantle. In the illustrated embodiment, container 100 is connected by a suitable connecting member 105, e.g., glass tubing, to a single fractionating means 200, which is vented to the atmosphere. Container 100 and its contents 90 are brought to the desired toasting temperature (e.g., preferably about 350°–375° C.) and an inert gas 130 is swept through the container 100 to sweep the volatile components 107 toward the fractionating means 200.

Fractionating means 200 contains a plurality of glass beads 202 which aid in distributing the gas stream through the water-imiscible solvent 204 contained therein. In this embodiment, the solvent 204 is triacetin, at room temperature. After the about two hours of passing the volatile components through the solvent, the reaction is stopped. After about 30–60 minutes, two liquid layers are detected in the fractionating means 200. The top layer 206 comprises the water vapor and water soluble components from the toasted tobacco volatiles 107. The bottom layer 204 is the triacetin solvent containing the desired flavor substances.

Figure 2B:
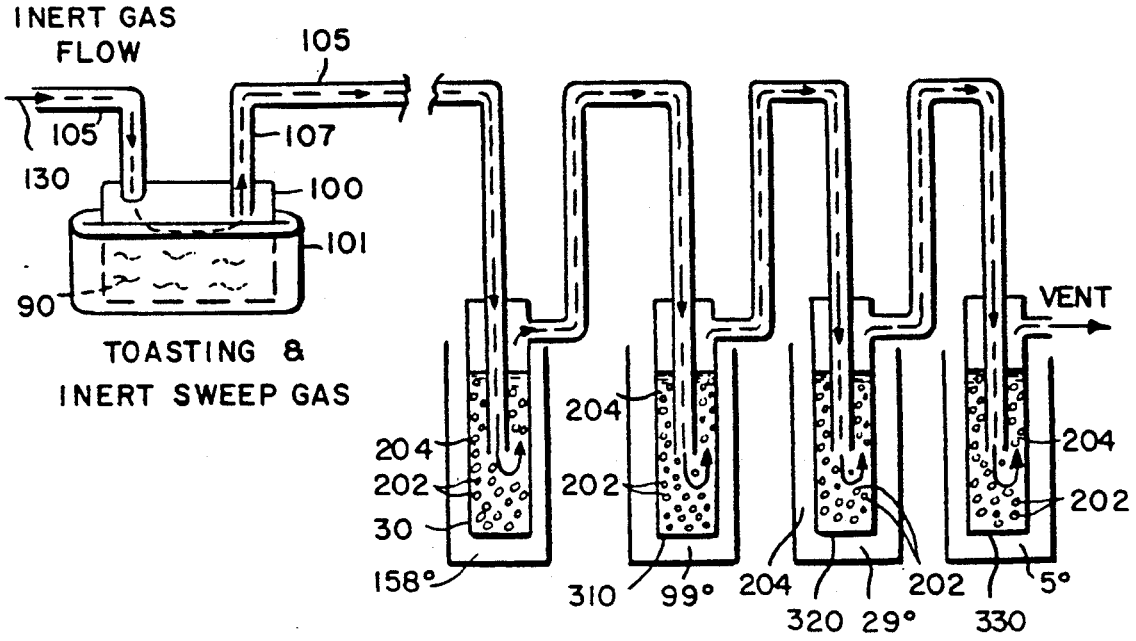

FIG. 2B illustrates another embodiment of the process of the present invention in schematic form. As with the two previous embodiments, tobacco 90 is placed in a suitable container 100 (e.g., on a laboratory scale process, a 1000 ml glass round-bottom flask) which is provided with heating means 101 such as an electric heating mantle. Container 100 is connected by a suitable connecting member 105, e.g., glass tubing, to a series of fractionating means 300, 310, 320, and 330, each of which contains a water-imiscible solvent which is maintained at a different temperature. In the illustrated embodiment these fractionating means are maintained at 158° C., 99° C., 29° C., and 5° C. respectively. These fractions being unique in taste and aroma (as well as volatility and chemical composition, the 158° fraction consisting of the least volatile components while the 5° fraction contains the most volatile components) may be used individually or in a blend. This type of fractionating allows for the selective removal of undesirable compounds from the blended flavor substance.

Container 100 and its contents 90 are brought to the desired toasting temperature (e.g., preferably about 375° C.) and an inert gas 130 is swept through the container 100 to sweep the volatile components 107 toward the series of fractionating means 300, 310, 320, and 330. In the each such fractionating means the gases interact with the triacetin contained therein, and as in the previously described embodiment, after a given period of time, the aqueous components and the organic components physically separate from one another. As in the previous embodiment, the most desirable flavor components are found in the organic phase.

Figure 3A:
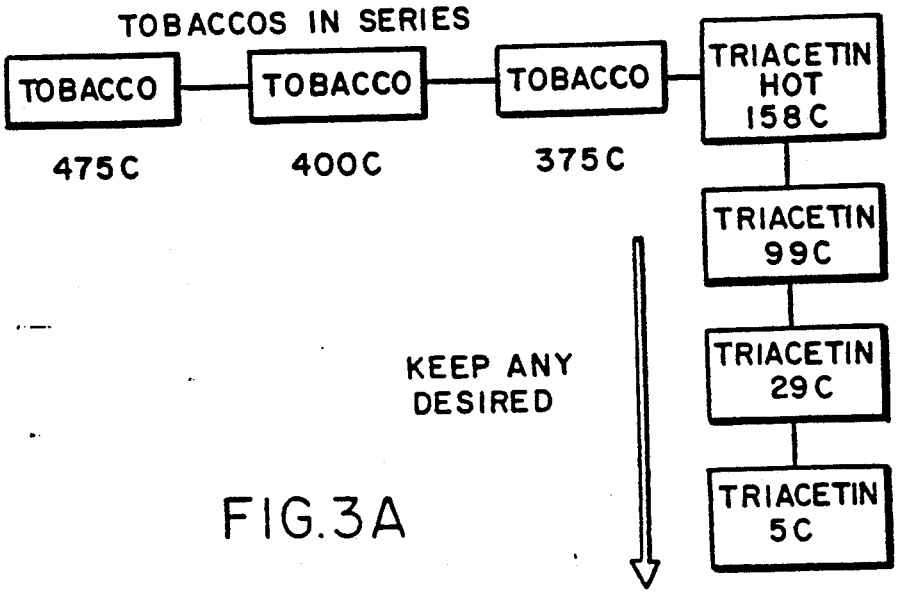
FIGS. 3A and 3B are schematic flow diagrams illustrating modifications of the process illustrated in FIG. 2B.
Figure 3B:
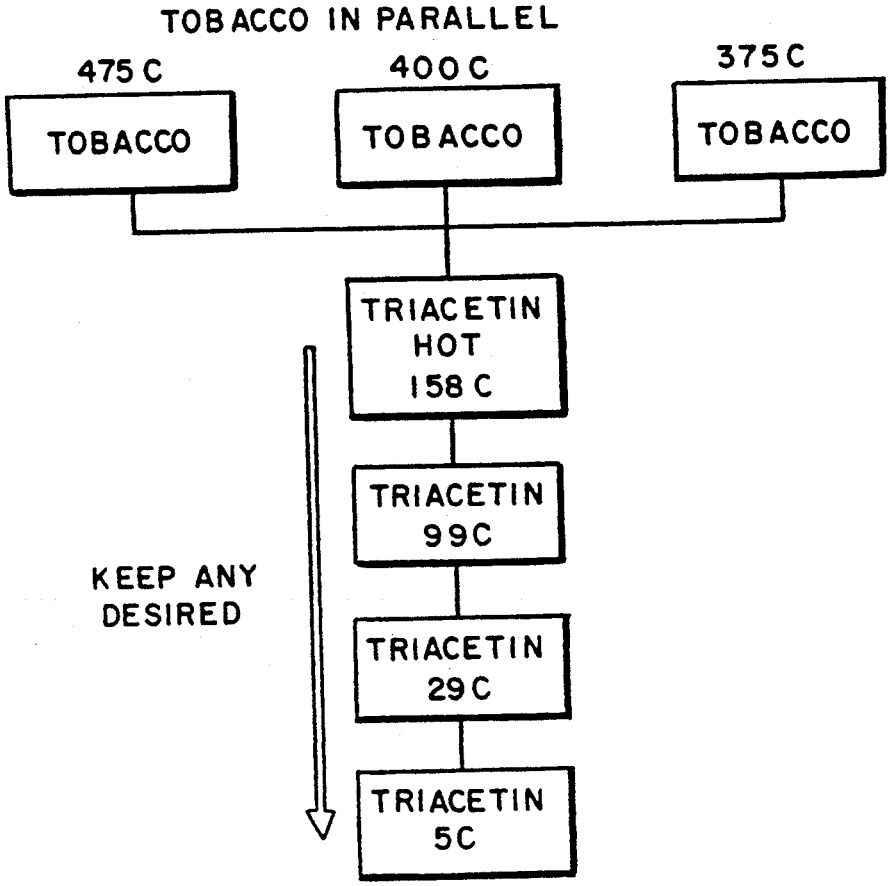

FIGS. 3A and 3B represent variations on the process depicted in FIG. 2B. In FIG. 3A, tobacco is toasted in a series of containers (e.g., three) each at a different temperature. As the skilled artisan will appreciate, any number of tobacco segments may be linked as described. The volatiles formed are passed in series through each of the connected toasting containers, and are thus subjected to a variety of physical and chemical environments before being fractionated.

In FIG. 3B, a number of individual tobaccos (e.g., three) are toasted at different temperatures and the volatiles thus formed are collected and combined prior to fractionation. By blending these volatiles, flavor substances different from those obtained in any of the previous methods may be obtained.

In each of the illustrated embodiments, the inert gas used as the sweep gas may be any gas which does not have a detrimental effect on the gaseous products evolved from the heated tobacco. Such gases include nitrogen, carbon dioxide, argon, and the like. The inert atmosphere is employed as a sweep gas, at a sufficient sweep velocity (cc/min.) to force the volatile components from container 100, through the condenser 110, and through the sorbent medium container 120. In the laboratory scale process described herein, this sweep velocity has typically been from about 500 cc/min. to 1500 cc/min. The skilled artisan will readily be capable of calculating effective sweep gas velocities for larger (or smaller) scale process schemes.

Thus, in accordance with the present invention, there is provided an improved flavor substance for use in smoking articles. The flavor substance is particularly suited for smoking articles having a small combustible fuel element, a physically separate aerosol generating means, and a separate mouthend piece such as the cigarette described in FIG. 4. Such cigarettes are described in detail in the aforesaid U.S. Pat. Nos. 4,756,318, 4,714,082, and 4,708,151.

Figure 4:
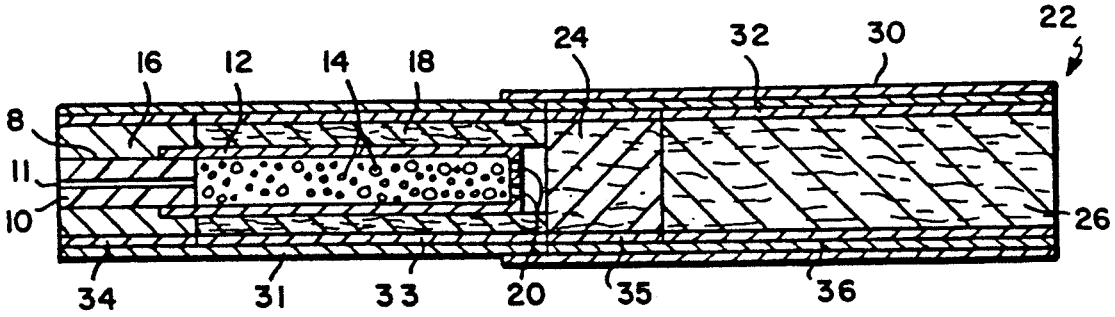
FIG. 4 is a longitudinal sectional view of a cigarette which may employ the flavor substance(s) of the present invention.

Referring in detail to the smoking article depicted in FIG. 4, there is illustrated a cigarette having a traditional size and shape i.e., about 7–8 mm in diameter and about 78 mm long.

Figure 4A:
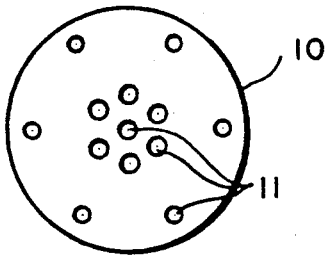
FIGS. 4A and 4B illustrate, from the lighting end, fuel element passageway configurations useful in the cigarette of FIG. 4.
Figure 4B:
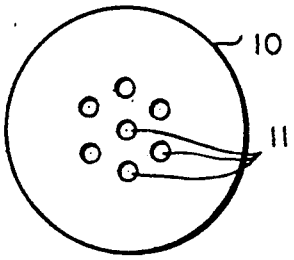

The lighting end of the article has a small carbonaceous fuel element 10 which is provided with a plurality of passageways 11 therethrough. One embodiment employs a fuel element having thirteen holes in an arrangement similar to that shown in FIG. 4A. Another has seven passageways arranged substantially as depicted in FIG. 4B.

The fuel element is formed from an extruded mixture of carbon (preferably a mixture of carbonized paper and carbon black), sodium carboxymethyl cellulose (SCMC) binder, and water, as described in greater detail below.

The periphery 8 of fuel element 10 is encircled by a resilient jacket of insulating fibers 16, such as glass fibers.

A metallic capsule 12 encloses the physically separate aerosol generating means which contains a substrate material 14 which carries one or more aerosol forming materials. The substrate may be in particulate form, in the form of a rod, or in other forms as described in U.S. Pat. Nos. 4,756,318, 4,714,082 and 4,708,151.

Capsule 12 is circumscribed by a roll of tobacco filler 18. Two passageways 20 are provided at the closed mouth end of the capsule. At the mouth end of tobacco roll 18 is a mouthend piece 22, preferably comprising a cylindrical segment of a tobacco paper filter 24 and a filter segment of non-woven thermoplastic (e.g., polypropylene or polyethylene) fibers 26 through which the aerosol passes to the user.

The article, or portions thereof, is overwrapped with one or more layers of cigarette papers 30–36.

The flavor substances of the present invention may be located in one or more of the non-burning components of the smoking article. For example, the flavor substances may be added to the capsule 12, either as a part of the substrate material 14, or in addition thereto. Moreover, the flavor substances may be added to all or a portion of the roll of tobacco surrounding the aerosol generating means 18, or placed in the mouthend piece members 24, or 26. Finally, the flavor substances may be incorporated in one or more of the wrappers 30–36 used to combine the various components of the smoking article.

The preferred carrier for the flavor substances of the present invention is the substrate material 14 which also carries one or more aerosol forming materials. When a solid sorbent medium is used in the process of the present invention, a portion (e.g., up to about 2 weight percent) of this solid, flavor substance loaded sorbent, is added to the substrate material and this mixture is used to fill the capsule. When a liquid sorbent medium is employed in the process of the present invention, a suitable portion (e.g., up to about 5 weight percent) of the flavor loaded sorbent is added to the solid substrate material used to fill the capsule.

The preparation and use of the new flavor substances of the present invention in cigarettes will be further illustrated with reference to the following examples which will aid in the understanding of the present invention, but which are not to be construed as a limitation thereof. All percentages reported herein, unless otherwise specified, are percent by weight. All temperatures are expressed in degrees Celsius.

EXAMPLES

GENERAL PROCEDURES

A. Preparation of Flavor Substances

Tobacco (50 to 200 grams) was added to a 1000 ml round bottom flask fitted with gas inlet and outlet tubes and a thermometer. The flask was placed in a heating mantle with a rheostat control. The gas inlet was connected to a source of inert gas. Both carbon dioxide and nitrogen were used as the sweep gas in these examples. The gas outlet from the round bottom flask was connected to a condenser having an inlet and outlet. The gas outlet of the condenser was connected to a sorbent medium container having an inlet and an outlet (vent). The condenser (e.g., cold traps) was maintained at about 0° C. with an ice/water mixture.

The tobacco was heated to the desired toasting temperature prior to the introduction of the sweep gas. After the desired toasting temperature was reached, vapors released during the toasting were swept through the condenser and then passed to the sorbent medium container, where the flavor substances were collected on various sorbent media. Gases not trapped by the sorbent medium were vented.

B. Cigarette Preparation

Cigarettes of the type illustrated in FIG. 4 were made in the following manner in order to test the various flavor substances formed by toasting tobacco as described above.

1. Fuel Source Preparation

The fuel element (10 mm long, 4.5 mm O.D.) having an apparent (bulk) density of about 0.86 g/cc, was prepared from hardwood pulp carbon (80 weight percent), Raven J lampblack carbon (unactivated, 0.02 μm, 10 wt. percent), and SCMC binder (10 wt. percent).

The hardwood pulp carbon was prepared by carbonizing a non-talc containing grade of Grand Prairie Canadian Kraft hardwood paper under a nitrogen blanket, at a step-wise increasing temperature rate of about 10° C. per hour to a final carbonizing temperature of 750° C.

After cooling under nitrogen to less than about 35° C., the paper carbon was ground to a mesh size of minus 200 (U.S.). This powdered carbon was then heated to a temperature of up to about 850° C. to remove volatiles.

After again cooling under nitrogen to less than about 35° C., the paper carbon was ground to a fine powder, i.e., a powder having an average particle size of from about 0.1 to 50 microns.

This fine carbon powder was admixed with the lampblack carbon, and Hercules 7HF SCMC binder in the weight ratios set forth above, together with sufficient water to make a stiff, dough-like paste.

Fuel elements were extruded from this paste having seven central holes each about 0.021 in. in diameter and six peripheral holes each about 0.01 in. in diameter. The web thickness or spacing between the central holes was about 0.008 in. and the average outer web thickness (the spacing between the periphery and peripheral holes) was 0.019 in. as shown in FIG. 2A.

These fuel elements were then baked-out under a nitrogen atmosphere at 900° C. for three hours after formation.

2. Spray Dried Tobacco

A blend of flue cured tobaccos were ground to a medium dust and extracted with water in a stainless steel tank at a concentration of from about 1 to 1.5 pounds tobacco per gallon water. The extraction was conducted at ambient temperature using mechanical agitation for from about 1 hour to about 3 hours. The admixture was centrifuged to remove suspended solids and the aqueous extract was spray dried by continuously pumping the aqueous solution to a conventional spray dryer, an Anhydro Size No. 1, at an inlet temperature of from about 215°–230° C. and collecting the dried powder material at the outlet of the drier. The outlet temperature varied from about 82°–90° C.

3. Preparation of Sintered Alpha Alumina

High surface area alpha alumina (surface area of about 280 $m^2/g$) from W. R. Grace & Co., having a mesh size of from −14 to +20 (U.S.) was sintered at a soak temperature of about 1400° C. to 1550° C. for about one hour, washed with water and dried. This sintered alpha alumina was combined, in a two step process, with the ingredients shown in Table I in the indicated proportions:

TABLE I

| | |
|---|---|
| Alpha alumina | 68.11% |
| Glycerin | 19.50% |
| Spray Dried Tobacco | 8.19% |
| HFCS (Invertose) | 3.60% |

TABLE I-continued

| | |
|---|---|
| Abstract of Cocoa | 0.60% |
| Total: | 100.0% |

In the first step, the spray dried tobacco was mixed with sufficient water to form a slurry. This slurry was then applied to the alpha alumina carrier described above by mixing until the slurry was uniformly absorbed by the alpha alumina. The treated alpha alumina was then dried to reduce the moisture content to about 1 weight percent. In the second step, this treated alpha alumina was mixed with a combination of the other listed ingredients until the liquid was substantially absorbed within the alpha alumina carrier.

4. Cartridge Assembly

The capsule used to construct the FIG. 2 cigarette was prepared from deep drawn aluminum. The capsule had an average wall thickness of about 0.004 in. (0.1 mm), and was about 30 mm in length, having an outer diameter of about 4.5 mm. The rear of the container was sealed with the exception of two slot-like openings (each about 0.65×3.45 mm, spaced about 1.14 mm apart) to allow passage of the aerosol former to the user.

About 330 mg of the aerosol producing substrate described above was used to load the capsule. As described in Section C, below, the flavor substances on solid sorbents were also added to this cartridge as a supplement to the standard substrate. A fuel element prepared as above, was inserted into the open end of the filled capsule to a depth of about 3 mm.

5. Insulating Jacket

The cartridge assembly (i.e., fuel element-capsule combination) was overwrapped at the fuel element end with a 10 mm long, glass fiber jacket of Owens-Corning C GLASS S-158 with 3 weight percent pectin binder, to a diameter of about 7.5 mm. The glass fiber jacket was then wrapped with an innerwrap material, a Kimberly-Clark experimental paper designated P780-63-5.

6. Tobacco Roll

A 7.5 mm diameter tobacco roll (28 mm long) with an overwrap of Kimberly-Clark's P1487-125 paper was modified by insertion of a probe to have a longitudinal passageway of about 4.5 mm diameter therein.

7. Frontend Assembly

The insulated cartridge assembly was inserted into the tobacco roll passageway until the glass fiber jacket abutted the tobacco roll. The glass fiber and tobacco sections were joined together by an outerwrap material which circumscribed both the fuel element/insulating jacket/innerwrap combination and the wrapped tobacco roll. The outerwrap was a Kimberly-Clark paper designated P1768-182.

8. Mouthend Piece Assembly

A mouthend piece of the type illustrated in FIG. 2, was constructed by combining two sections; (1) a 10 mm long, 7.5 mm diameter carbon filled tobacco sheet material adjacent the capsule, overwrapped with Kimberly-Clark's P850-184-2 paper and (2) a 30 mm long, 7.5 mm diameter cylindrical segment of a non-woven melt-blown thermoplastic polypropylene web obtained from Kimberly-Clark Corporation, designated PP-100-F, overwrapped with Kimberly-Clark Corporation's P1487-184-2 paper.

The carbon filled tobacco sheet material was prepared by incorporating about 17% of PCB-G activated carbon from Calgon Carbon Corporation into a paper furnish used to make a sheet material obtained from Kimberly-Clark Corporation under the designation P144-185-GAPF.

The carbon filled sheet material was formed into a filter member using a double cone system which comprises a cone within a cone as the preforming apparatus. The carbon filled sheet material was fed into the annular space between the cones in a substantially tension-free state, such that at the entry point, the sheet material wrapped around the radial portion of the inner cone. The cones were moved in relation to each other in order to achieve the desired uniformity and firmness of the cylindrical segment. The polypropylene was formed using the same double cone system.

These two sections were combined with a combining overwrap of Kimberly-Clark Corporation's P850-186-2 paper.

9. Final Assembly

The combined mouthend piece section was joined to the jacketed cartridge capsule section by a final overwrap of Ecusta's 30637-801-12001 tipping paper.

C. Testing of the Flavor Substances

Sorbent materials which contained the absorbed flavor substances of the present invention were added either to capsule 12 of the cigarette of FIG. 4, or placed on the tobacco sheet material section 24 of the mouthend piece 22.

For flavor materials trapped on solid sorbent media, the loading of the trapped flavor materials was conducted at very low levels, typically less than about 2% by weight of the total capsule loading (10–45 mg) of the solid sorbent medium, i.e., taste testing was conducted by adding from about 10 mg to 40 mg of the solid sorbent medium to the cigarettes of FIG. 2, in the capsule 12.

For flavor materials sorbed on liquid sorbent materials, the tobacco sheet material used to form the tobacco paper filter was sprayed with the liquid sorbent at a level of about 4.5% by weight.

Smoking the thus modified cigarettes yielded what was commonly referred to as a good "tobacco smoke" taste.

EXAMPLE 1

Tobacco (60 g) was removed from Tampa Nugget cigars and placed in the heating vessel described in the general procedures section. The tobacco was toasted at 400° C. for 1.5 hours with a nitrogen sweep gas (900–1000 cc/min.) and the gas was passed through a single cold trap (about 0° C.) to a sorbent medium container bearing 1.6746 g of unsintered alpha alumina. The alpha alumina weight increased 0.9552 g after being exposed to the vapors from the toasted tobacco.

EXAMPLE 2

Tobacco (60 g) was removed from Camel Light brand cigarettes. The tobacco was toasted at 400° C. for 1.5 hours and processed as in Example 1. Uncondensed vapors were passed through 2.5091 g of sintered alpha alumina, which increased in weight 0.4906 g.

EXAMPLE 3

Cigar tobacco (60 g) was toasted at 400° C. for 1.5 hours as described in Example 1. Uncondensed vapors were passed through 2.5489 g of sintered alpha alumina. Following absorption, the alpha alumina showed an increase in weight of 1.8936 g.

EXAMPLE 4

Tobacco (60 g) was removed from Tampa Nugget cigars and toasted at 400° C. as described in Example 1. Uncondensed vapors were passed through 2.6181 g of sintered alpha alumina. After absorption of the flavor substances, the alpha alumina showed an increase in weight of 0.6050 g.

EXAMPLE 5

Cigar tobacco (60 g) was toasted at 350° C. for 1.5 hours as described in Example 1 and the uncondensed vapors were passed through 2.6470 g of sintered alpha alumina. Following absorption, the weight of the alpha alumina increased by 0.7939 g.

EXAMPLE 6

Cigar tobacco (60 g) was toasted at 375° C. for 1.5 hours as described in Example 1 and the uncondensed vapors were passed through 2.6265 g of sintered alpha alumina. After absorption of the flavor substance vapors, the alpha alumina showed an increase in weight of 0.9254 g.

EXAMPLE 7

Sintered alpha alumina, further containing 11% spray dried tobacco (see general procedures, supra) and 23% glycerin was used to collect uncondensed vapors from 60 g of cigar tobacco, toasted at 400° C. for 1.5 hours, under the collection conditions of Example 1. The initial weight of the sorbent alpha alumina was 3.6514 g. The weight of vapor collected was 1.5530 g.

EXAMPLE 8

Turkish tobacco (60 g) was toasted at 400° C. for 1.5 hours as described in Example 1. The uncondensed vapors were passed through 2.5338 g of sintered alpha alumina. The weight of vapor collected was 0.1022 g.

EXAMPLE 9

Turkish tobacco (60 g) was toasted at 400° C. for 1.5 hours as described in Example 1. The vapors were bubbled through 50 ml of a liquid sorbent medium, glycerin.

EXAMPLE 10

A 60 g mixture of flue cured tobacco (90%) and cocoa (10%) was toasted at 400° C. for 1.5 hours as described in Example 1. Uncondensed vapors were passed through 1.2134 g of sintered alpha alumina. The weight of vapor collected was 0.8904 g.

EXAMPLE 11

Spray dried tobacco (see General Procedures, supra) (60 g) was toasted at 400° C. for 1 hour as described in Example 1. Uncondensed vapors were passed through 1.2062 g of sintered alpha alumina. The weight of vapor trapped was 2.3597 g.

EXAMPLE 12

Cigar tobacco (60 g) was toasted at 375° C. for 1 hour as described in Example 1. Uncondensed vapor from the cold trap was bubbled into 50 ml of glycerin through a glass tube which had a fritted disc on the end. This produced fine bubbles of vapor in the glycerin, allowing the vapor to be dispersed throughout.

EXAMPLE 13

A blend of 75% Burley and 25% Turkish tobaccos (60 g) was toasted at 375° C. for 1 hour as described in Example 1. Uncondensed vapor was bubbled into glycerin as described in Example 15.

EXAMPLE 14

Cigar tobacco (60 g) was toasted at 375° C. for 1 hour as described in Example 1. Uncondensed vapors were passed through 3.625 g of sintered alpha alumina. The weight of flavor substances collected was 2.4019 g.

EXAMPLE 15

The tobacco blend of Example 16 (60 g) was toasted at 375° C. for 1 hour as described in Example 1. Uncondensed vapor was passed through 1.81 g of sintered alpha alumina. The weight of flavor substances collected was 1.9096 g.

EXAMPLE 16

Example 15 was repeated using 4.0764 g of sintered alpha alumina. The weight of flavor substances collected was 2.6651 g.

EXAMPLE 17

The tobacco blend of Example 13 (60 g) was toasted at 375° C. for 1 hour under a nitrogen gas flow (900–1,000 cc/min.). The resulting vapors were passed through two cold traps connected in series, each maintained at 0° C. The uncondensed vapors passing through the two cold traps were passed through a glass column containing 2.0476 g of sintered alpha alumina. The weight of flavor substances collected on the alpha alumina was 0.3373 g.

EXAMPLE 18

The tobacco blend of Example 16 (60 g) was toasted at 400° C. for 1 hour as described in Example 21. Uncondensed vapors were passed through 2.003 g of sintered alpha alumina. The weight of flavor substances collected was 0.2215 g.

EXAMPLE 19

The tobacco blend of Example 16 (60 g) was toasted at 400° C. for 1 hour as described in Example 1 (one cold trap) and the uncondensed vapors were passed through 2.0259 g of sintered alpha alumina. The weight of flavor substances collected was 0.4353 g.

EXAMPLE 20

Cigar tobacco (60 g) was toasted at 375° C. for 1 hour as described in Example 21 (two cold traps) and the uncondensed vapors were passed through 2.0343 g of sintered alpha alumina. The weight of flavor substances collected was 0.4224 g.

EXAMPLE 21

Flue cured tobacco (60 g) was toasted at 375° C. for 1 hour as described in Example 21 and the uncondensed vapors were passed through 2.0077 g of sintered alpha alumina. The weight of flavor substances collected was 0.5248 g.

EXAMPLE 22

Example 25 was repeated at 400° C. The weight of alpha alumina was 2.0087 g and the weight of flavor substances collected was 0.4170 g.

EXAMPLE 23

The tobacco blend of Example 16 (60 g) was toasted at 400° C. for 1 hour as described in Example 1 (one cold trap). The weight of sintered alpha alumina was 2.0548 g. The weight of flavor substances collected was 0.3360 g.

EXAMPLE 24

The tobacco blend of Example 16 (60 g) was toasted at 400° C. under a purge gas of $CO_2$ gas (900–1,000 cc/min.) for 1 hour. The vapors were passed to a single cold trap at 0° C. and uncondensed vapors were passed through a glass tube containing 2.0182 g of sintered alpha alumina. The weight of flavor substances collected on the alpha alumina was 0.3162 g.

EXAMPLE 25

Example 28 was repeated except that the uncondensed vapors from the cold trap were passed through 2.0371 g of Calgon PXC carbon. The weight of flavor substances collected was 0.5189 g.

EXAMPLE 26

Flue cured tobacco stems (60 g, unwashed) were toasted at 400° C. for 1 hour as described in Example 1. Uncondensed vapors were passed through 2.0040 g of sintered alpha alumina. The weight of flavor substances collected was 0.8417 g.

EXAMPLE 27

Burley tobacco stems (60 g, unwashed) were toasted at 400° C. for 1 hour as described in Example 1. Uncondensed vapors were passed through 2.0024 g of sintered alpha alumina. The weight of flavor substances collected was 0.5042 g.

EXAMPLE 28

Flue cured tobacco (60 g) was toasted at 375° C. for 1 hour under a nitrogen gas flow (900–1,000 cc/min.). The resulting vapors were passed through three separate cold traps connected in series, each maintained at 0° C. Uncondensed vapors were passed through four different experimental Calgon carbons as shown below.

| | |
|---|---|
| #1 | 2.0168 g of Calgon carbon No. 2755-5-B weight of flavor substances collected, 0.1890 g. |
| #2 | 2.0169 g of Calgon carbon No. 2755-5-C weight of flavor substances collected, 0.3513 g. |
| #3 | 2.0100 g of Calgon carbon No. 2755-5-D weight of flavor substances collected, 2.779 g. |
| #4 | 2.0050 g of Calgon carbon No. 2755-5-E weight of flavor substances collected, 0.3613 g. |

EXAMPLE 29

Pennsylvania leaf cigar tobacco (300 g) was toasted at 375° C. for one hour under a nitrogen gas flow (300–500 cc/min.). The vapors were passed through three cold traps in series at ice water temperature. The uncondensed vapors were bubbled through a tube of 0.60 in. I.D. The tube contained 175 g of glass beads of approximately 0.100 in. O.D. to 0.175 in. O.D. and 50 g of triacetin. The height of the column of glass beads and triacetin was 23 inches.

EXAMPLE 30

Winston ® blend tobacco (300 g) was toasted at 375° C. for one hour under a nitrogen gas flow (300–500 cc/min.). The generated vapors were passed directly into a column containing 50 g triacetin containing sufficient glass beads to promote good bubble contact. After collecting the material generated by the toasting process a two-phase liquid was observed in the column. Analysis thereof indicated an upper aqueous layer and a lower triacetin layer. The aqueous layer was pipetted off and the triacetin layer was collected for use as a flavor substance.

EXAMPLE 31

Doral ® tobacco (300 g) was toasted at 425° C. for one hour under a nitrogen gas flow (300–500 cc/min.). The generated vapors were passed directly into a column containing 50 g triacetin containing sufficient glass beads to promote good bubble contact. After collecting the material generated by the toasting process a two-phase liquid was observed in the column. Analysis thereof indicated an upper aqueous layer and a lower triacetin layer. The aqueous layer was pipetted off and the triacetin layer was collected for use as a flavor substance.

EXAMPLE 32

Camel ® blend tobacco (300 g) was toasted at 375° C. for one hour under a nitrogen gas flow (300–500 cc/min.). The generated vapors were passed directly into a column containing 50 g triacetin containing sufficient glass beads to promote good bubble contact. After collecting the material generated by the toasting process a two-phase liquid was observed in the column. Analysis thereof indicated an upper aqueous layer and a lower triacetin layer. The aqueous layer was pipetted off and the triacetin layer was collected for use as a flavor substance.

EXAMPLE 33

Doral ® tobacco (300 g) was toasted at 400° C. for one hour under a nitrogen gas flow (300–500 cc/min.). The generated vapors were passed directly into a column containing 50 g triacetin containing sufficient glass beads to promote good bubble contact. After collecting the material generated by the toasting process a two-phase liquid was observed in the column. Analysis thereof indicated an upper aqueous layer and a lower triacetin layer. The aqueous layer was pipetted off and the triacetin layer was collected for use as a flavor substance.

EXAMPLE 34

In a 1000 ml container 65 g of finely powdered Doral ® blend tobacco was toasted at 400° C. for one hour under a nitrogen purge using an apparatus substantially as illustrated in FIG. 2B. During this time the vapors from the tobacco were fractionated by passing them through four 250 ml flasks, each such flask containing 30 ml of triacetin and 100 g of glass beads. The four flasks [A, B, C, and D] were maintained at temperatures of 230° C., 100° C., 30° C., and 5° C. respectively. Each of the collection flasks afforded a triacetin fraction which was useful as a flavor substance—each such fraction being unique in its flavor and aroma characteristics.

EXAMPLE 35

In a 1000 ml container 150 g of finely powdered Doral® blend tobacco was toasted at 375° C. for one hour under a nitrogen purge using an apparatus substantially as illustrated in FIG. 2B. During this time the vapors from the tobacco were fractionated by passing them through four 250 ml flasks, each containing 30 ml of triacetin and 100 g of glass beads. The four flasks [A, B, C, and D] were maintained at temperatures of 158° C., 99° C., 30° C., and 5° C. respectively. Each of the collection flasks afforded a triacetin fraction which was useful as a flavor substance—each fraction being unique in its flavor and aroma characteristics.

EXAMPLE 36

Example 35 was repeated but the tobacco toasted was 150 g of finely powdered Turkish tobacco at 375° C.

EXAMPLE 37

Example 35 was repeated but the tobacco toasted was 150 g of finely powdered Doral® blend tobacco at 450° c.

EXAMPLE 38

The apparatus of FIG. 3A is used, which differs from that of FIG. 2B by the addition of two 500 ml flasks between the toasting container (with 150 g tobacco) and the first triacetin container. The two added containers each containing 75 g of tobacco. The toasting container is heated under a nitrogen purge to 475° C., while the first and second additional tobacco containers are heated at 400° and 325° respectively. The resulting tobacco vapors (which simulate the temperature profile behind the firecone of a burning cigarette) are collected as in Example 35.

EXAMPLE 39

Example 38 is repeated, but instead of arranging the toasted tobacco samples in series (as in Example 38) the toasting process is conducted in parallel (See FIG. 3B). Each tobacco sample is heated independently of the others and all of the vapors are brought together and passed through the fractionation apparatus of Example 35. As in Example 35, any one or more fractionated samples may be used as a flavor substance as desired.

COMPARATIVE EXAMPLE

Tampa Nugget cigar tobacco (180 g) was toasted under a nitrogen sweep gas (900–1,000 cc/min.) at 300° C. for 1.5 hours and the vapors were passed through a single cold trap maintained at 0° C. which trapped 28.5 g of liquid condensate.

Taste analysis of the materials trapped in the cold trap was conducted by adding about 10 mg of the condensate to capsule 12 in the cigarette illustrated in FIG. 2.

Smoking the thus modified cigarette yielded what was commonly referred to as an "ash-tray" taste.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A process for producing flavor substances from tobacco, comprising:

(a) heating tobacco in an inert atmosphere to a temperature of at least about 200° C., thereby driving off volatile materials from the tobacco;

(b) fractionating the volatile materials driven off by heating the tobacco; and (c) collecting at least a portion of the fractionated volatile materials as flavor substances.

2. The process of claim 1, wherein the tobacco is heated at a temperature of at least about 225° C.

3. The process of claim 1, wherein the tobacco is heated at a temperature of from about 225° C. to 450° C.

4. The process of claim 1, wherein the tobacco is heated at a pressure above atmospheric.

5. The process of claim 1, wherein the tobacco is heated at a pressure below atmospheric.

6. The process of claim 1, which further comprises the use of an inert sweep gas to carry the volatile materials from step (a) through step (c).

7. The process of claim 1, wherein the fractionation is conducted via condensation within the temperature range of from about −50° C. to about 20° C.

8. The process of claim 1, wherein the fractionation conducted via condensation within the temperature range of from about −10° to about 5° C.

9. The process of claim 1, wherein the fractionation is conducted via condensation at a temperature of about 0° C.

10. The process of claim 1, which further comprises the use of a sorbent medium to collect at least a portion of the uncondensed volatile materials.

11. The process of claim 1 or 10, wherein the tobacco is heated at a temperature of from about 300° to about 500° C.

12. The process of claim 10, wherein the sorbent medium comprises a solid sorbent.

13. The process of claim 12, wherein the sorbent medium comprises alpha alumina.

14. The process of claim 12, wherein the sorbent medium comprises carbon.

15. The process of claim 14, wherein the sorbent medium comprises activated carbon.

16. The process of claim 14, wherein the sorbent medium comprises deactivated carbon.

17. The process of claim 12, wherein the sorbent medium comprises tobacco.

18. The process of claim 10, wherein the sorbent medium comprises a liquid sorbent.

19. The process of claim 18, wherein the liquid sorbent medium comprises glycerin.

20. The process of claim 18, wherein the liquid sorbent medium comprises a vegetable oil.

21. The process of claim 18, wherein the liquid sorbent medium comprises triacetin.

22. A process for producing flavor substances from tobacco, comprising:

(a) heating tobacco in an inert atmosphere to a temperature of at least about 200° C., thereby driving off volatile materials from the tobacco;

(b) fractionating the volatile materials driven off by heating the tobacco via an organic—aqueous, liquid-liquid separation means; and (c) collecting at least a portion of the fractionated volatile materials as flavor substances.

23. The process of claim 22, wherein the tobacco is heated at a temperature of at least about 225° C.

24. The process of claim 22, wherein the tobacco is heated at a temperature of from about 225° C. to 450° C.

25. The process of claim 22, which further comprises the use of an inert sweep gas to carry the volatile materials from step (a) through step (c).

26. The process of claim 22, wherein the fractionation is conducted with a plurality liquid-liquid separation means, each maintained separately at a temperature within the range of from about −50° C. to about +300° C.

27. The process of claim 26, wherein the plurality of liquid-liquid separation means have temperatures within the range of from about −10° to about +200° C.

28. The process of claim 22, wherein the organic component of the liquid-liquid separation means is triacetin.

29. A process for producing flavor substances from tobacco, comprising:

(a) heating a first tobacco segment in an inert atmosphere at a temperature of about 475° C., thereby driving off volatile materials from the tobacco;

(b) heating a second tobacco segment in an inert atmosphere at a temperature of about 475° C., thereby driving off volatile materials from the tobacco;

(c) heating a third tobacco segment in an inert atmosphere at a temperature of about 325° C., thereby driving off volatile materials from the tobacco;

(d) passing the volatile materials from the first tobacco segment into the second tobacco segment, thereafter passing the combined volatiles through the third tobacco segment, thus yielding volatiles which are a mixture of all three tobacco segments;

(e) fractionating the volatile materials combined in step (d) via an organic—aqueous, liquid-liquid separation means; and (f) collecting at least a portion of the fractionated volatile materials as flavor substances.

30. A process for producing flavor substances from tobacco, comprising:

(a) heating a first tobacco segment in an inert atmosphere at a temperature of about 475° C., thereby driving off volatile materials from the tobacco;

(b) heating a second tobacco segment in an inert atmosphere at a temperature of about 400° C., thereby driving off volatile materials from the tobacco;

(c) heating a third tobacco segment in an inert atmosphere at a temperature of about 325° C., thereby driving off volatile materials from the tobacco;

(d) independently collecting and combining the volatile materials from the three tobacco segments, thus yielding volatiles which are a mixture of all three tobacco segments;

(e) fractionating the volatile materials combined in step (d) via an organic—aqueous, liquid-liquid separation means; and (f) collecting at least a portion of the fractionated volatile materials as flavor substances.

31. A flavor substance made by the process of claim 1, 2, 3, 4, 5, 6, 7, 8, 9, 10, 12, 13, 14, 15, 16, 17, 18 19, 20, 21, 22, 23, 24, 25, 26, 27, 28, 29, or 30.

* * * * *

UNITED STATES PATENT AND TRADEMARK OFFICE

CERTIFICATE OF CORRECTION

PATENT NO. : 5,038,802

DATED : August 13, 1991

INVENTOR(S) : Jackie L. White et al.

It is certified that error appears in the above—identified patent and that said Letters Patent is hereby corrected as shown below:

Col. 3, line 62, before "the", insert --preferred process of--.

Col. 3, line 63, after "and", insert --2B--.

Col. 17, line 27, "475°" should be --400°--.

Signed and Sealed this

Tenth Day of November, 1992

*Attest:*

*Attesting Officer*

DOUGLAS B. COMER

*Acting Commissioner of Patents and Trademarks*